US008978187B2

(12) United States Patent
Maxik et al.

(10) Patent No.: US 8,978,187 B2
(45) Date of Patent: Mar. 17, 2015

(54) SYSTEM FOR ELECTROSTATIC REMOVAL OF DEBRIS AND ASSOCIATED METHODS

(71) Applicant: Lighting Science Group Corporation, Satellite Beach, FL (US)

(72) Inventors: Fredric S. Maxik, Indialantic, FL (US); David E. Bartine, Cocoa, FL (US); Pedro Medelius, Merritt Island, FL (US)

(73) Assignee: Lighting Science Group Corporation, Melbourne, FL (US)

( * ) Notice: Subject to any disclaimer, the term of this patent is extended or adjusted under 35 U.S.C. 154(b) by 0 days.

(21) Appl. No.: 14/210,576

(22) Filed: Mar. 14, 2014

(65) Prior Publication Data

US 2014/0259468 A1 Sep. 18, 2014

Related U.S. Application Data

(60) Provisional application No. 61/787,174, filed on Mar. 15, 2013.

(51) Int. Cl.
*A47L 13/40* (2006.01)
*B08B 6/00* (2006.01)

(52) U.S. Cl.
CPC ..... *B08B 6/00* (2013.01)
USPC ..... 15/1.51

(58) Field of Classification Search
CPC ..... B08B 6/00; H01L 21/02041; A47L 13/40
USPC ..... 15/1.51, 246
See application file for complete search history.

(56) References Cited

U.S. PATENT DOCUMENTS

| | | | | |
|---|---|---|---|---|
| 6,911,593 | B2 * | 6/2005 | Mazumder et al. | 136/251 |
| 6,988,925 | B2 | 1/2006 | Arthur et al. | |
| 8,091,167 | B2 * | 1/2012 | Teo et al. | 15/1.51 |
| 8,513,531 | B2 | 8/2013 | Trigwell et al. | |

* cited by examiner

*Primary Examiner* — Laura C Guidotti
(74) *Attorney, Agent, or Firm* — Mark R. Malek; Daniel C. Pierron; Widerman Malek, PL

(57) ABSTRACT

A debris removal device for electrostatically removing debris may include a sheet comprising a plurality of conductive traces and a driver circuit positioned in electrical communication with the conductive traces of the sheet. Each conductive trace may be spaced apart from adjacent conductive traces. Furthermore, the driver circuit may be configured to selectively energize subsets of the plurality of conductive trace. The driver circuit may be configured to energize the subsets of the plurality of conductive traces sequentially.

20 Claims, 4 Drawing Sheets

SYSTEM FOR ELECTROSTATIC REMOVAL OF DEBRIS AND ASSOCIATED METHODS

RELATED APPLICATIONS

This application is related to and claims the benefit under 35 U.S.C. §119(e) of U.S. Provisional Patent Application Ser. No. 61/787,174 titled System for Electrostatic Removal of Debris and Associated Methods filed Mar. 15, 2013 (Attorney Docket No. 221.00156), and is related to U.S. Patent Application Ser. No. 61/792,737 titled System and Methods of Embedding Material in a Glass Substrate (Attorney Docket No. 221.00073), the contents of each of which is incorporated by reference herein in their entirety, except to the extent disclosures made therein are inconsistent with disclosures made herein.

FIELD OF THE INVENTION

The present invention relates to systems and methods for removing particulate matter from a surface.

BACKGROUND

Self-cleaning surfaces present an advantage in a wider variety of scenarios where traditional cleaning methods, such as hand-cleaning, are unfavorable or impracticable. An example of such a scenario includes the cleaning of windows in high-rise structures, where accessing the exposed surface of such windows requires either scaffolding, which can be very dangerous and at times impossible, or cost-prohibitive robotic cleaning systems. Another example includes the surface of photovoltaic panels, which have substantial surface area and suffer performance degradation when said surface is occluded by particulate matter, reducing the capacity for light to pass therethrough. Cleaning of photovoltaic panels requires significant man-hours and reduces the economic feasibility of the panels for use in electricity generation.

Current self-cleaning surface solutions rely on the use of hydropohobic or hydrophilic materials. However, in both instances, such solutions require water to move across the surface for cleaning to be effectuated. In many instances, an area may be without precipitation for substantial periods of time, thereby rendering such solutions ineffective. Accordingly, there is a need in the art for a self-cleaning surface solution that does not require precipitation to function.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

With the above in mind, embodiments of the present invention advantageously provide the ability to remove debris from a surface while minimizing labor necessary to do so. More specifically, embodiments of the present invention are related to a debris removal device for electrostatically removing debris. The debris removal device may include a sheet comprising a plurality of conductive traces, a driver circuit positioned in electrical communication with the conductive traces of the sheet. Each conductive trace may be spaced apart from adjacent conductive traces. Additionally, the driver circuit may be configured to selectively energize subsets of the plurality of conductive traces. Furthermore, the driver circuit may be configured to energize the subsets of the plurality of conductive traces sequentially.

In some embodiments, the plurality of conductive traces may be formed of at least one of conductive metal, metal alloys, graphite, carbon nanomaterials, carbon nanotubes, graphene, and conductive polymers. Furthermore, the sheet may be formed of a transparent or translucent material. Additionally, the sheet may be configured to be attached to a surface.

The plurality of conductive traces may be positioned so as to define spacing therebetween within the range from about 5 mils to about 50 mils. The driver circuit may be configured to generate signals having waveforms of constant voltage, fixed-frequency sinusoidal, swept-frequency sinusoidal, random frequency sinusoidal, half-wave rectified sinusoidal, full-wave rectified sinusoidal, square, triangle, and sawtooth. Furthermore, the driver circuit may be configured to generate signals including waveforms of single, two-phase, and three-phase excitations.

In some embodiments of the present invention, the plurality of conductive traces may be configured to permit a voltage within the range from about 500 volts to about 3000 volts. In further embodiments, the plurality of conductive traces may be configured to permit a voltage within the range from about 1000 volts to about 2500 volts. In some embodiments, the plurality of conductive traces may be configured to generate electrostatic fields having a frequency within from about 100 Hz to about 2000 kHz.

The sheet may comprise first, second, third, and fourth electrical contacts positioned in electrical communication with the driver circuit. The plurality of conductive traces may comprise first, second, third, and fourth sets of electrical contacts. Additionally, the first set of conductive traces may be positioned in electrical communication with the first electrical contact, the second set of conductive traces may be positioned in electrical communication with the second electrical contact, the third set of conductive traces may be positioned in electrical communication with the third electrical contact, and the fourth set of conductive traces may be positioned in electrical communication with the fourth electrical contact.

Furthermore, in some embodiments, the conductive traces of the first set of conductive traces may be adjacent to a conductive trace of at least one of the second and fourth sets of conductive traces. Additionally, the conductive traces of the second set of conductive traces may be adjacent to a conductive trace of at least one of the first and third sets of conductive traces. Furthermore, the conductive traces of the third set of conductive traces may be adjacent to a conductive trace of at least one of the second and fourth sets of conductive traces. The conductive traces of the fourth set of conductive traces may be adjacent to a conductive trace of at least one of the third and first sets of conductive traces.

Additionally, in some embodiments, the driver circuit may be configured to energize each of the first, second, third, and fourth electrical contacts independently of each other, thereby energizing each of the first, second, third, and fourth sets of conductive traces independently of each other. Furthermore, the driver circuit may be configured to iteratively perform a sequence of energizing each of the first, second, third, and fourth sets of conductive traces to move particulate matter off an exposed surface of the sheet. Additionally, the driver circuit may be configured to energize the plurality of conductive traces in a sequence of the first set of conductive traces, the second set of conductive traces, the third set of conductive traces, and the fourth set of conductive traces. In some embodiments, the plurality of conductive traces may be at least one of embedded, integrally formed, surface deposited, and printed to the sheet.

DETAILED DESCRIPTION OF THE PREFERRED EMBODIMENT

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Those of ordinary skill in the art realize that the following descriptions of the embodiments of the present invention are illustrative and are not intended to be limiting in any way. Other embodiments of the present invention will readily suggest themselves to such skilled persons having the benefit of this disclosure. Like numbers refer to like elements throughout.

Although the following detailed description contains many specifics for the purposes of illustration, anyone of ordinary skill in the art will appreciate that many variations and alterations to the following details are within the scope of the invention. Accordingly, the following embodiments of the invention are set forth without any loss of generality to, and without imposing limitations upon, the claimed invention.

In this detailed description of the present invention, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present invention.

An embodiment of the invention, as shown and described by the various figures and accompanying text, provides a system for generating a sequence of electrostatic fields across a surface to impart motion to particulate matter disposed thereupon so as to remove the particulate matter therefrom. Types of particulate matter include, but is not limited to, dust, dirt, soil, sand, and any other matter of generally granular configuration and of sufficiently small diameter, as discussed in greater detail hereinbelow. The system may generally include a plurality of conductive traces formed into, on, or otherwise associated with a sheet that is attachable to a surface. The conductive traces may be configured such that current may flow therethrough, thereby generating an electric field. The electric filed may interact with particulate matter disposed on the sheet and/or the surface, imparting motion to the particles. The system may energize the conductive traces to generate a sequence of electric fields that impart motion to the particles so as to move the particles off the sheet and/or the surface.

Figure 1:
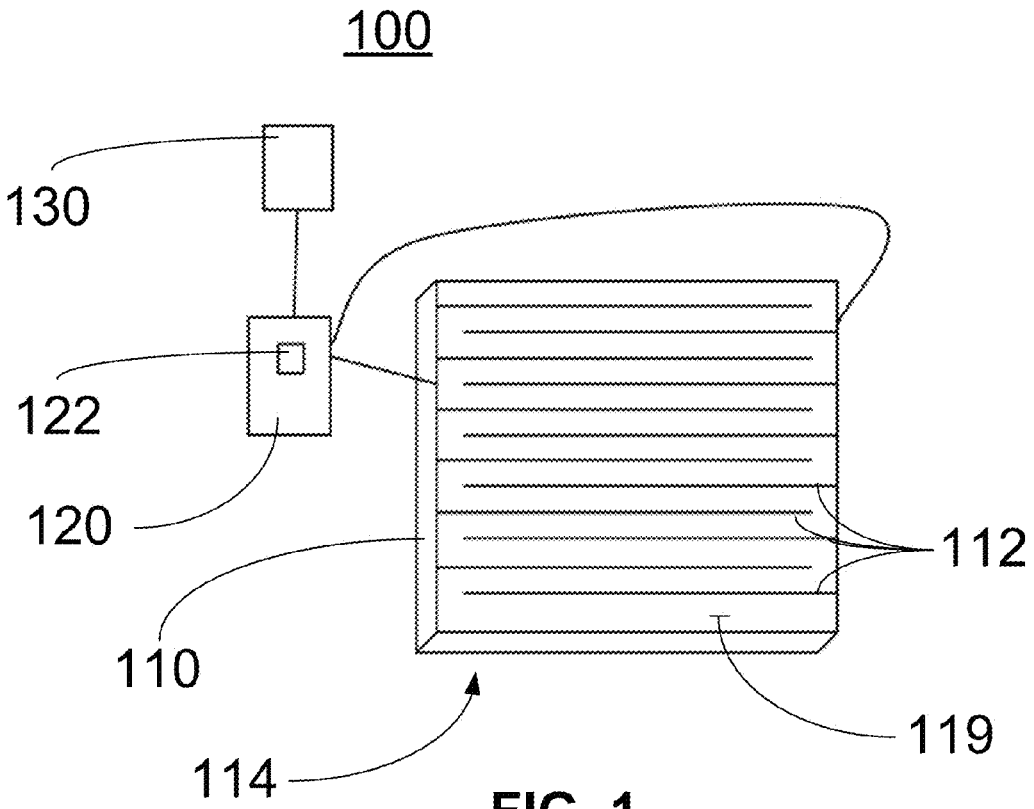
FIG. 1 is a schematic depiction of an embodiment of the present invention.

Referring now to FIG. 1, a schematic view of an embodiment of the presented invention is depicted. The debris removal system 100 may include a sheet 110, a driver circuit 120, and a power supply 130. The sheet 110 may include a plurality of conductive traces 112. The plurality of conductive traces 112 may be embedded, integrally formed, surface deposited, printed, or otherwise attached to the sheet 110. The plurality of conductive traces 112 may be formed of any conductive material, including, but not limited to, conductive metals and metal alloys, graphite, carbon nanotubes, carbon nanomaterials, graphene, conductive polymers, and combinations thereof.

The sheet 110 may be fabricated so as to facilitate attachment of the plurality of conductive traces 112. Furthermore, the sheet 110 may be configured to facilitate attachment of the sheet 110 to a surface of a structure. The sheet 110 may comprise an attachment surface 114 that is configured to facilitate attachment to the surface. In some embodiments, the attachment surface 114 may include a layer of material, such as a glue or adhesive, configured to cause the attachment surface 114 to bind, adhere, stick, or otherwise attach to the surface. Furthermore, in some embodiments, the attachment surface 114 may be configured to attach to the surface by static cling.

The sheet 110 may be additionally configured to be generally transparent, permitting the propagation of electromagnetic radiation therethrough. In some embodiments, the sheet 110 may be transparent to certain ranges of wavelengths of electromagnetic radiation, including, but not limited to, the visible spectrum, the infrared spectrum, the microwave spectrum, the radio spectrum, the ultraviolet spectrum, the x-ray spectrum, and the gamma ray spectrum. Similarly, the plurality of conductive traces 112 may be formed of materials that are transparent to some or all of the spectra of electromagnetic radiation listed above. Additionally, in some embodiments, the plurality of conductive traces 112 may be of sufficiently small diameter such that any electromagnetic radiation absorbed or blocked by the plurality of conductive traces 112 is negligible compared to that which propagates through the sheet 110.

The sheet 110 may be formed of any material that may be attached to a surface of a structure as described hereinabove, and that also permits the plurality of conductive traces 112 to be attached. Moreover, the sheet 110 may be formed of a material that is generally non-conductive of electricity, facilitating the electrical isolation of the various elements of the invention. Types of material include, but are not limited to, plastics, polymers, glasses, ceramics, and any other material that may include the various characteristics described herein. Moreover, the sheet 110 may be formed of two or more of the aforementioned materials.

The surface may be any surface capable of receiving the sheet 110. For example, the surface may be generally smooth, may be generally chemically unreactive, and may be generally free of surface characteristics inhibiting or otherwise interfering with attachment thereto. For example, in some embodiments, the surface may be a window, a covering or optic for an optical device, such as a lamp, luminaire, or photovoltaic device, and the like. In some other embodiments, the surface may be the surface of furniture, such as a table top, a shelf, a counter, a seat surface, a desk, and the like. It is appreciated that the surface may be any surface having the characteristics described hereinabove.

The plurality of conductive traces 112 may be attached to the sheet 110 in a desired configuration. For example, in some embodiments, the plurality of conductive traces 112 may be attached to the sheet 110 in a spaced apart fashion. For example, in some embodiments, the plurality of conductive traces 112 may be attached to the sheet 110 such that the spacing between adjacent conductive traces is within the range from about 5 thousandths of an inch ("mils") to about 50 mils. In some embodiments, the plurality of conductive traces 112 may spaced apart in a uniform fashion. In some other embodiments, the plurality of conductive traces 112 may be spaced apart at varying distances across the sheet 110. The spacing between the plurality of conductive traces 112 may be configured to impart motion to particulate matter of varying composition and geometric configuration, such as diameter, as will be discussed in greater detail hereinbelow. Additionally, in some embodiments, the spacing between the plurality of conductive traces 112 may be configured such that, where alternating conductive traces are energized, the distance between the energized conductive traces may be within the range from about 10 mils to about 50 mils. It is contemplated and included within the scope of the invention that varying patterns of energization of the plurality of conductive traces 112 are contemplated and included within the scope of the invention, and that the spacing of the plurality of conductive traces 112 may similarly be varied.

The plurality of conductive traces 112 may be attached at any position on the sheet 110 such that an electrostatic field generated by current conducted therethrough may be incident upon and impart motion to particulate matter on an exposed surface 119 of the sheet 110. In some embodiments, the plurality of conductive traces 112 may be positioned on the exposed surface 119. Alternatively, in some embodiments, the plurality of conductive traces 112 may be positioned at an interior position within the sheet 110. The positioning of the plurality of conductive traces 112 at an interior position may measured as a distance between the plurality of conductive traces 112 and the exposed surface 119. The distance may be any distance that enables the electrostatic field generated by the plurality of conductive traces 112 to impart motion to particulate matter on the exposed surface 119. The distance may depend on the electromagnetic permittivity of the material forming the sheet 110, the magnitude of the electrostatic field capable of being generated by the plurality of conductive traces 112, and the magnitude of an electrostatic field necessary to impart motion to the particulate matter on the exposed surface 119.

The plurality of conductive traces 112 may be configured so as to have sufficient thermal dissipation capacity so as not to overheat and suffer performance degradation or physical deformation. Moreover, the sheet 110 may be configured to be in thermal communication with the plurality of conductive traces 112 so as to increase the thermal dissipation capacity thereof. Heat generated by the plurality of conductive traces 112 is a function of current flowing therethrough. The plurality of conductive traces 112 may be configured to permit a current of at least about 100 nanoamps to flow therethrough without any deleterious effect.

Furthermore, in some embodiments, the plurality of conductive traces 112 may be configured to permit current of varying waveforms to conduct therethrough. For example, the types of waveforms that may be conducted by the plurality of conductive traces 112 may include, but are not limited to, constant voltage/direct current, fixed-frequency sinusoidal, swept-frequency sinusoidal, random frequency sinusoidal, half-wave rectified sinusoidal, full-wave rectified sinusoidal, square wave, triangle wave, and sawtooth waveforms. Additionally, waveforms having single, two-phase, and three-phase excitations with similar or different frequencies and patterns may be conducted by the plurality of conductive traces 112. As such, it is contemplated and included within the scope of the invention that the plurality of conductive traces 112 may be configured to conduct current having any of the above waveforms, as well as combinations thereof.

Additionally, the plurality of conductive traces 112 may be configured to permit high-voltage current to conduct therethrough. In some embodiments, the plurality of conductive traces 112 may be configured to permit current having a voltage within the range from about 500 volts to about 3000 volts. In some further embodiments, the plurality of conductive traces 112 may be configured to permit current having a voltage within the range from about 1000 volts to about 2500 volts.

Additionally, the plurality of conductive traces 112 may be configured to generate electrostatic fields having a frequency within a range of frequencies. The range of frequencies may be from about 100 Hz to about 2000 kHz.

Furthermore, in some embodiments, the sheet 110 may include two or more sets of pluralities of conductive traces. For example, referring now to FIG. 2, sheet 110 may include a first set 116' of a plurality of conductive traces, a second set 116" of a plurality of conductive traces, a third set 116''' of a plurality of conductive traces, and a fourth set 116'''' of a plurality of conductive traces. The inclusion of four sets of pluralities of traces is exemplary only, and any number of sets is contemplated and included within the scope of the invention.

Each of the sets of plurality of traces 116', 116", 116''', 116'''', may include traces that are substantially straight, and are parallel to the traces of the other sets. It is appreciated that any configuration of traces are included within the scope of the invention, so long as that traces from respective sets are electrically isolated from one another. The sets of the plurality of traces 116', 116", 116''', 116'''' may be interlaced, such that a sequence of traces may be established. For example, starting from a first side 111' of the sheet 110 and moving in the direction of a second side 111", there may be a trace of the first set of plurality of traces 116', a trace of the second set of plurality of traces 116", a trace of the third set of plurality of traces 116''', and a trace of the fourth set of plurality of traces 116''''. This sequence may establish a pattern that may be repeated from the first side 111' to the second side 111". In some embodiments, that sequence of traces from the respective sets of pluralities of traces 116', 116", 116''', 116'''' may be repeated or it may vary across the sheet 110. Furthermore, in some embodiments, one or more of the sets of pluralities of traces 116', 116", 116''', 116'''' may be present only toward one side of the sheet 110.

As described hereinabove, the traces of the sets of plurality of traces 116', 116", 116''', 116'''' may be positioned on a surface of the sheet 110 or may be positioned at an interior position of the sheet 110. In some embodiments, as in the present embodiment, each of the sets of pluralities of traces 116', 116", 116''', 116'''' may be positioned on the exposed surface 119. In some embodiments, at least one of the sets of plurality of traces 116', 116", 116''', 116'''' may be positioned on the exposed surface 119, and another of the sets of pluralities of traces 116', 116", 116'", 116"" may be positioned at an interior position of the sheet 110. In some other embodiments, each of the sets of plurality of traces 116', 116", 116'", 116"" may be positioned at an interior position of the sheet 110.

Figure 2:
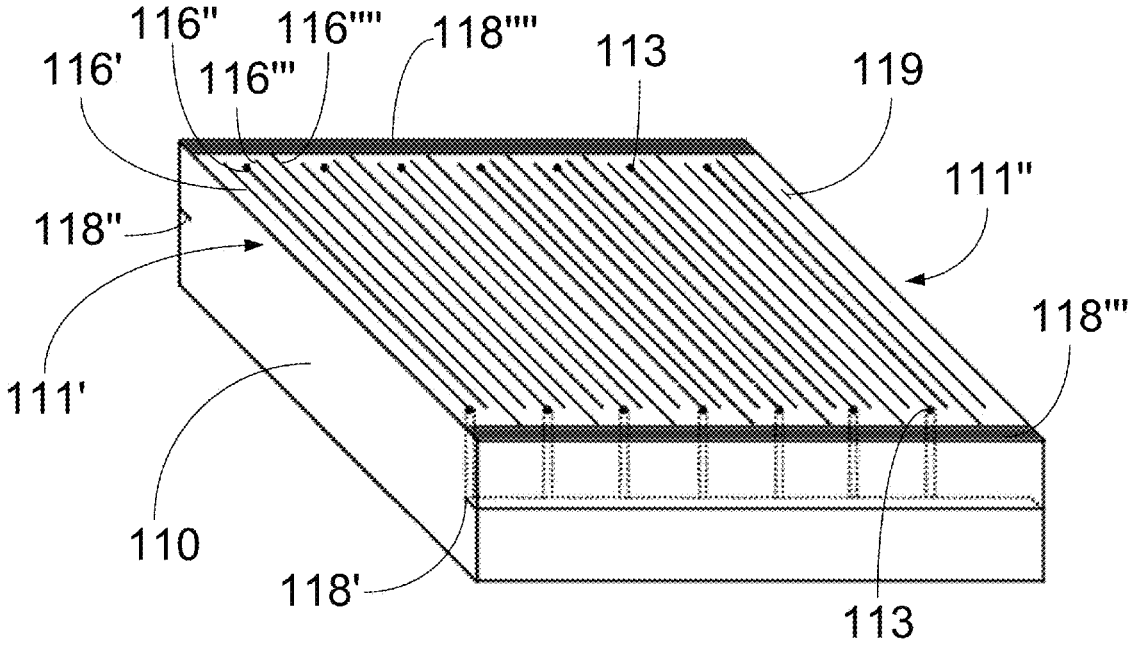
FIG. 2 is a perspective view of an embodiment of the invention depicted in FIG. 1.

Additionally, each of the sets of pluralities of traces 116', 116", 116'", 116"", may have associated therewith an electrical contact 118', 118", 118'", 118"". The electrical contacts 118', 118", 118'", 118"" may be electrically coupled to the associated sets of plurality of traces 116', 116", 116'", 116"", and may further be positioned in electrical communication with a computerized device, such as a microcontroller, as will be discussed in greater detail hereinbelow. Similar to the traces, the electrical contacts 118', 118", 118'", 118"" may be positioned on the sheet 110 so as to be electrically isolated from one another. In some embodiments, a first electrical contact 118' may be positioned on one side of the exposed surface 119 of the sheet 110, and a second electrical contact 118" may be positioned on another side 118" of the exposed surface 119. A third electrical contact 118'" may be positioned at one side of an interior position within the sheet 110, and a fourth electrical contact 118"" may be positioned at another side of an interior position of the sheet 118"". It is appreciated that each of the electrical contacts 118', 118", 118'", 118"" may be positioned on any surface or at any interior position of the sheet 110 so long the electrical contacts 118', 118", 118'", 118"" are electrically isolated from one another and are able to deliver current to the associated set of plurality of traces 116', 116", 116'", 116"".

Where all of the sets of plurality of conductive traces 116', 116", 116'", 116"" are positioned approximately co-planar respective to each other, for example on the exposed surface 119, one or more of the associated contacts 118', 118", 118'", 118"" may be positioned on the sheet 110 on a plane other than the plane of the associated set of plurality of conductive traces. In such embodiments, each of the traces of the set of plurality of traces that is positioned on a plane other than the associated contact may include a plurality of vias configured to establish electrical coupling between the traces and the associated contact. For example, as depicted in FIG. 2, the traces of each of the first and second sets of plurality of conductive traces 116', 116" may include a via 113 at one end of the plurality of traces. The via 113 may be positioned at the end of the trace that is nearest the side of the sheet 110 that the respective contacts 118', 118" is positioned. The vias 113 may traverse through the sheet 110 to electrically couple the sets of plurality of conductive traces 116', 116" to their respective contacts 118', 118".

Referring now back to FIG. 1, the driver circuit 120 will now be discussed in greater detail. The driver circuit 120 may be any electronic circuit that may be electrically coupled to each trace of the plurality of conductive traces 112 to selectively energize any number of the plurality of conductive traces 112. For example, the driver circuit 120 may include a microcontroller 122. The microcontroller 122 may be programmed to selectively energize the plurality of conductive traces 112 in a sequence configured to move particulate matter from the exposed surface 119 of the sheet 110.

Additionally, the driver circuit 120 may be in electrical communication with the power supply 130. The driver circuit 120 may include circuitry necessary to modify the electricity provided by the power supply 130 in order to be provided to the plurality of conductive traces 112 in any of the voltage, waveform, phase, and frequency described herein.

For example, referring now to both FIGS. 1 and 2, the microcontroller 122 may be positioned in electrical communication with each of the contacts 118', 118", 118'", 118"". By selectively energizing one or more of the contacts 118', 118", 118'", 118"", the microcontroller 122 may accordingly selectively energize the associated sets of plurality of conductive traces 116', 116", 116'", 116"". Moreover, the microcontroller 122 may be programmed to selectively energize the sets of plurality of conductive traces 116', 116", 116'", 116"" in a variety of sequences and patterns, within a variety of voltages, with a variety of waveforms, a variety of frequencies, and in various phases. Each of the sequences, patterns, frequencies, voltages, patterns, waveforms, and phases that the plurality of traces may be energized by, and the electrostatic fields created thereby, are discussed hereinabove and below. The various sequences, patterns, voltages, waveforms, and phases may be selected so as to impart motion to particulate matter of various sizes. It is contemplated that electrostatic fields generated by varying sequences, patterns, voltages, waveforms, and phases may impart motion to particulate matter for varying sizes. For example, in some embodiments, the microcontroller 122 may be programmed energize the plurality of traces 112 so as to impart motion to particulate matter within a range of diameter from about 1 micron to about 200 microns. It is further contemplated that the microcontroller 122 may be programmed to impart motion to particulate matter within any sub-range while purposefully not imparting motion to particulate matter outside the sub-range. Accordingly, in some embodiments, the invention may sort particulate matter according to diameter by selectively imparting motion to particulate matter within a selective diameter range. Such an application may be used wherever it is desirous to sort particulate matter according to diameter, including, but not limited to, ore processing.

For example, a first sequence the microcontroller 122 may energize the plurality of conductive traces 112 may be first energizing the first set of plurality of conductive traces 116' to generate a first electrostatic field, second energizing the second set of plurality of conductive traces 116" to generate a second electrostatic field, third energizing the third set of plurality of conductive traces 116'" to generate a third electrostatic field, and fourth energizing the fourth set of plurality of conductive traces 116"" to generate a fourth electrostatic field. Each of the first, second, third, and fourth electrostatic fields may have similar characteristics or they may be different. The sequence may be repeated for any number of cycles. In some embodiments, the sequence may be repeated for at least as many traces are included in one or more of the sets of plurality of conductive traces 116', 116", 116'", 116"".

Figure 3A:
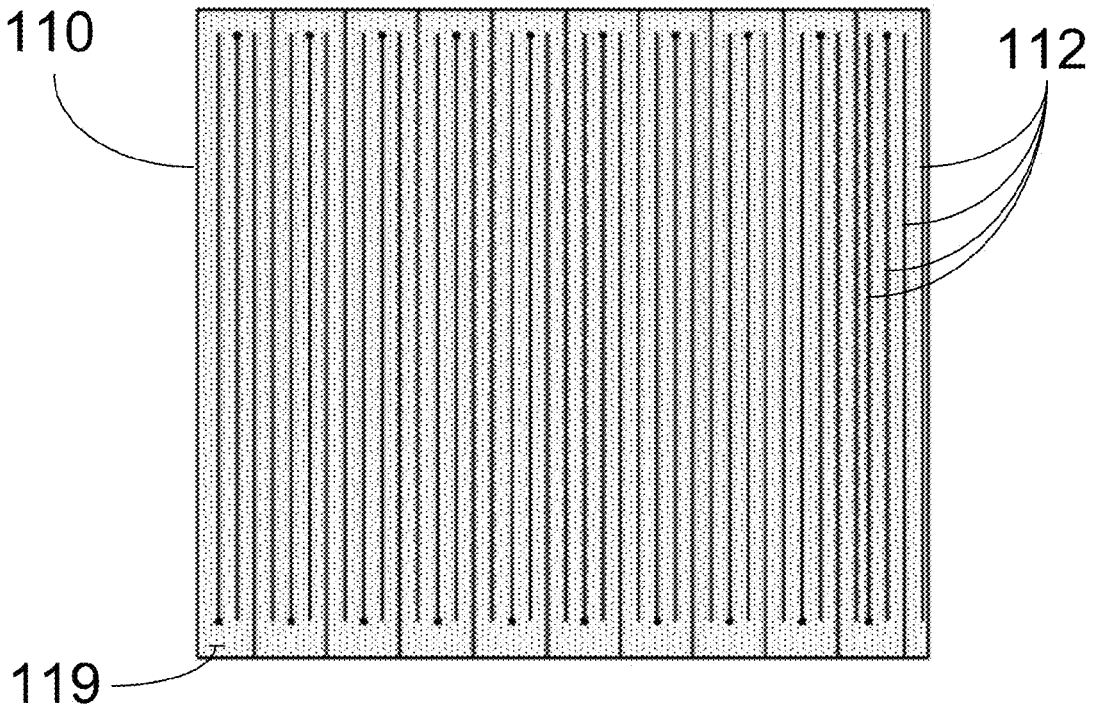
FIG. 3*a* is an elevation view of an embodiment of the invention depicted in FIG. 2 with particulate matter on an exposed surface of a sheet of the embodiment.
Figure 3B:
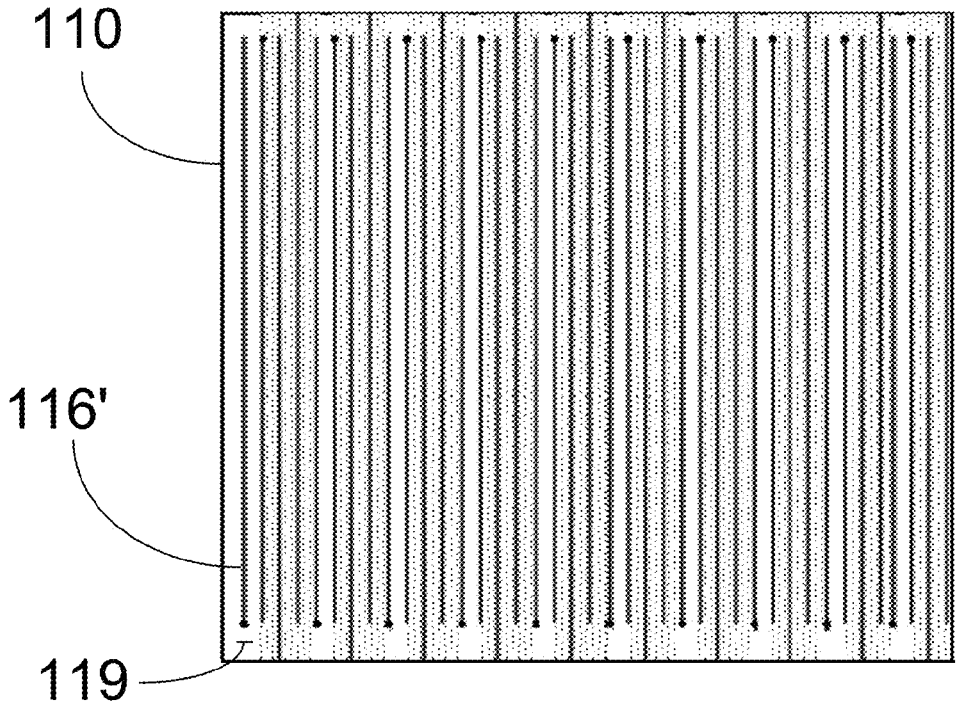
FIG. 3*b* is an elevation view of an embodiment of the invention depicted in FIG. 3*a* where a first partial sequence of electrostatic fields has been generated to move the particulate matter off the sheet.
Figure 3C:
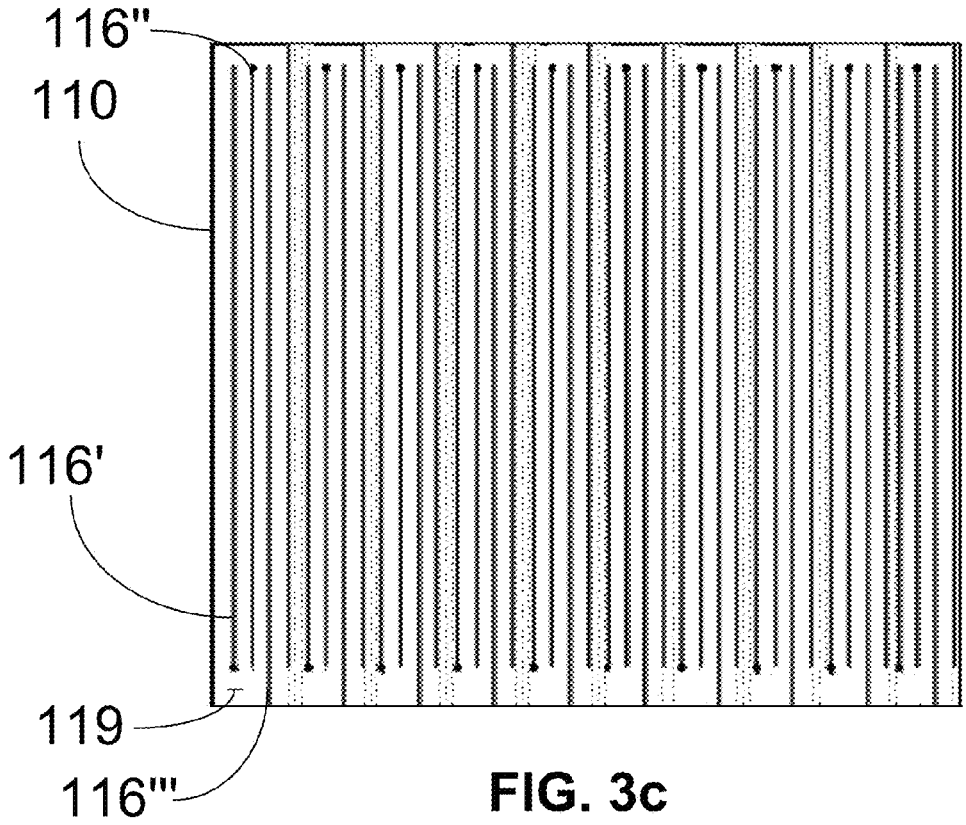
FIG. 3*c* is an elevation view of an embodiment of the invention depicted in FIGS. 3*a* and *b* where a second partial sequence of electrostatic fields has been generated to move the particulate matter of the sheet.
Figure 3D:
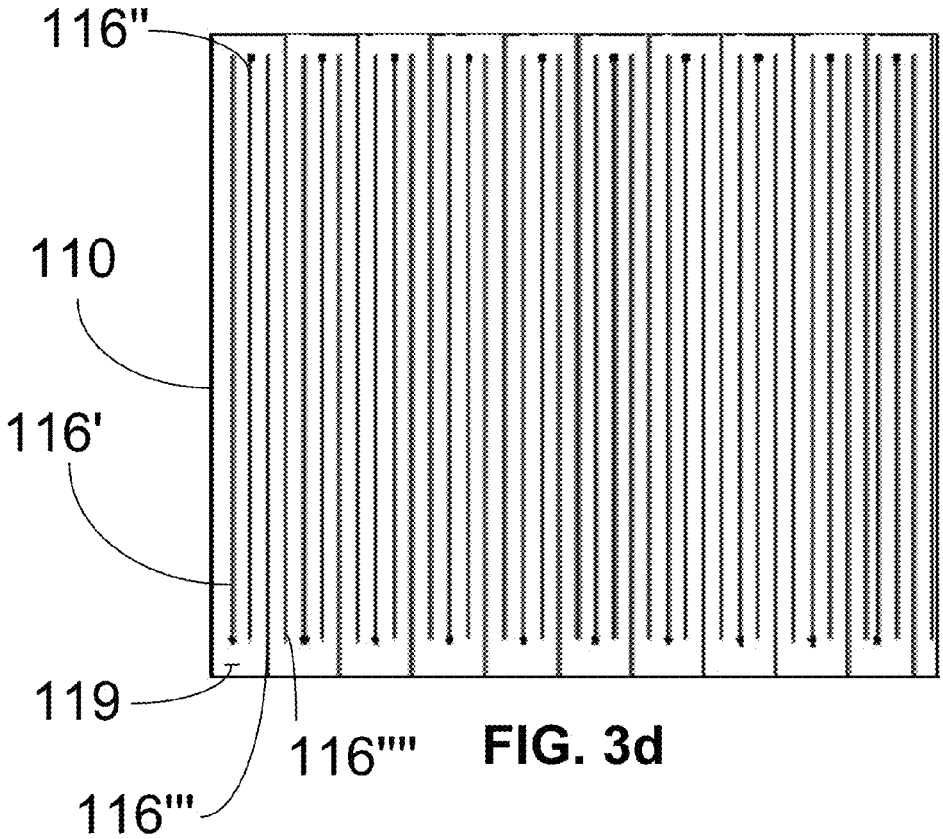
FIG. 3*d* is an elevation view of an embodiment of the invention depicted in FIGS. 3*a-c* where an entire sequence of electrostatic fields has been generated to remove the particulate matter off the sheet.

For example, referring now to FIGS. 3*a-d*, an embodiment of the invention is presented wherein particulate matter is positioned on the exposed surface 119 of the sheet 110. In FIG. 3*a*, none of the traces of the plurality of traces 112 have been energized, and hence the particulate matter has had no motion imparted thereto. In FIG. 3*b*, a first partial sequence, as described hereinabove, has been run, such that some of the traces of the plurality of conductive traces 112 have been energized to generate an electrostatic field. For example, the first set of plurality of conductive traces 116' may have been energized, thereby imparting motion to particulate matter within the vicinity of those traces. The particulate matter may be generally repelled by the electrostatic field. It is contemplated that the electrostatic field generated by the plurality of traces 112 may be configured to selectively repel or attract particulate matter. The particulate matter can be seen to have been moved in the direction of one of the sides of the exposed surface 119. In FIG. 3*c*, a second partial sequence has been run, such that more of the traces of the plurality of conductive traces 112 have been energized to generate electrostatic fields. For example, each of the first, second, and third sets of plurality of conductive traces 116', 116", 116'" may have been energized to generate electrostatic fields. As is apparent, more of the particulate matter has been moved further across the exposed surface 119. In FIG. 3*d*, a complete sequence has been run. In this depiction, the complete sequence is interpreted as a sufficient number of iterations of sequences have been run such that the particulate matter has been moved off the exposed surface 119.

Furthermore, it is appreciated and included within the scope of the invention that other sequences, i.e. sequences other than subsequent energization of adjacent conductive traces, exist and may be utilized to move particulate matter. For example, in a first step of a sequence, each of the first and third sets of plurality of conductive traces 116', 116''', may be simultaneously energized to generate electrostatic fields. The electrostatic fields generated by the first and third sets of plurality of conductive traces 116', 116''' may be similar or they may be different. In a second step, each of the second and fourth sets of plurality of conductive traces 116'', 116'''' may be simultaneously energized to generate electrostatic fields. Similarly, the electrostatic fields generated by the second and fourth sets of plurality of conductive traces 116'', 116'''' may be similar or they may be different. This sequence may be repeated until the exposed surface 119 is substantially or entirely free of particulate matter to which motion is imparted by the electrostatic fields generated by this sequence. It is appreciated that the permutations of the number and arrangement of conductive traces energized and combinations of conductive traces energized may vary according to the number and arrangement of groupings of the conductive traces, the configuration of the interlacing of groupings of the conductive traces, the number of conductive traces, the spacing between conductive traces, the diameter of particulate matter desired to be moved, the characteristics of the electrostatic fields generated by the conductive traces, and many other factors. Accordingly, any sequence of energization of the plurality of conductive traces 112 is contemplated and within the scope of the invention.

Additionally, it is appreciated that the plurality of conductive traces 112 may be capable of generating two or more electrostatic fields simultaneously, wherein the microcontroller 122 produces two or more signals on a single conductive trace such that the conductive trace generates two distinct electrostatic fields. In such embodiments, particulate matter responsive to varying electrostatic fields may have motion imparted thereto simultaneously. Accordingly, the superposition of two or more signals to the plurality of conductive traces, and the superposition of two or more resultant electrostatic fields, is included within the scope of the invention.

Referring now back to FIG. 1, the invention may further include detection circuitry. The detection circuitry may be configured to detect changes in electrical characteristics of one of the sheet 110, for example the exposed surface 119, and the plurality of conductive traces 112. The detection of changes to electrical characteristics of one of the aforementioned elements may indicate the presence of particulate matter thereupon and may trigger the microcontroller 122 to initiate an energization sequence of the plurality of conductive traces. For example, the detection circuitry may detect a change in resistance, reactance, or capacitance of the aforementioned elements from a baseline level. If the change is beyond a threshold level of change, the detection microcontroller 122 may commence energization of the plurality of conductive traces 112. The threshold level may be configured to represent a sufficient amount of particulate matter being positioned on the exposed surface 119 that may be undesirable for any reason, such as, for example, obstructing an undesirable or unacceptable amount of electromagnetic radiation, such as light.

It is appreciated that the series of FIGS. 3*a-d* are an accurate depiction for the sequence to remove particulate matter of approximately equal diameter. It is appreciated that, where particulate matter of sufficiently different diameters are present on the exposed surface 119, two or more sequences of energizing the plurality of conductive traces 112 to generate electrostatic fields having characteristics configured to impart motion to the varying diameters of particulate matter may be required to be run before the exposed surface 119 may be substantially or completely free of particulate matter positioned thereupon.

Some of the illustrative aspects of the present invention may be advantageous in solving the problems herein described and other problems not discussed which are discoverable by a skilled artisan.

While the above description contains much specificity, these should not be construed as limitations on the scope of any embodiment, but as exemplifications of the presented embodiments thereof. Many other ramifications and variations are possible within the teachings of the various embodiments. While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims.

Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item. Thus, the scope of the invention should be determined by the appended claims and their legal equivalents, and not by the examples given.

What is claimed is:

1. A debris removal device for electrostatically removing debris comprising:

a sheet comprising:

first, second, third, and fourth electrical contacts, a first set of conductive traces positioned in electrical communication with the first electrical contact, a second set of conductive traces positioned in electrical communication with the second electrical contact, a third set of conductive traces positioned in electrical communication with the third electrical contact, and a fourth set of conductive traces positioned in electrical communication with the fourth electrical contact; and a driver circuit positioned in electrical communication with each of the first, second, third, and fourth electrical contacts;

wherein each conductive trace is spaced apart from adjacent conductive traces;

wherein the driver circuit is configured to selectively energize each of the first, second, third, and fourth set of conductive traces; and wherein the driver circuit is configured to iteratively perform a sequence of energizing each of the first, second, third, and fourth sets of conductive traces.

2. The debris removal device of claim 1 wherein the plurality of conductive traces are formed of at least one of conductive metal, metal alloys, graphite, carbon nanomaterials, carbon nanotubes, graphene, and conductive polymers.

3. The debris removal device of claim 1 wherein the sheet is formed of a transparent or translucent material.

4. The debris removal device of claim 1 wherein the sheet is configured to be attached to a surface.

5. The debris removal device of claim 1 wherein the plurality of conductive traces are positioned so as to define spacing therebetween within the range from about 5 mils to about 50 mils.

6. The debris removal device of claim 1 wherein the driver circuit is configured to generate signals having waveforms of constant voltage, fixed-frequency sinusoidal, swept-frequency sinusoidal, random frequency sinusoidal, half-wave rectified sinusoidal, full-wave rectified sinusoidal, square, triangle, and sawtooth.

7. The debris removal device of claim 1 wherein the driver circuit is configured to generate signals including waveforms of single, two-phase, and three-phase excitations.

8. The debris removal device of claim 1 wherein the plurality of conductive traces are configured to permit a voltage within the range from about 500 volts to about 3000 volts.

9. The debris removal device of claim 1 wherein the plurality of conductive traces are configured to permit a voltage within the range from about 1000 volts to about 2500 volts.

10. The debris removal device of claim 1 wherein the plurality of conductive traces are configured to generate electrostatic fields having a frequency within from about 100 Hz to about 2000 kHz.

11. The debris removal device of claim 1 wherein the conductive traces of the first set of conductive traces are adjacent to a conductive trace of at least one of the second and fourth sets of conductive traces; wherein the conductive traces of the second set of conductive traces are adjacent to a conductive trace of at least one of the first and third sets of conductive traces; wherein the conductive traces of the third set of conductive traces are adjacent to a conductive trace of at least one of the second and fourth sets of conductive traces; and wherein the conductive traces of the fourth set of conductive traces are adjacent to a conductive trace of at least one of the third and first sets of conductive traces.

12. The debris removal device of claim 1 wherein the driver circuit is configured to energize each of the first, second, third, and fourth electrical contacts independently of each other, thereby energizing each of the first, second, third, and fourth sets of conductive traces independently of each other.

13. The debris removal device of claim 1 wherein the driver circuit is configured to energize the plurality of conductive traces in a sequence of the first set of conductive traces, the second set of conductive traces, the third set of conductive traces, and the fourth set of conductive traces.

14. The debris removal device of claim 1 wherein the plurality of conductive traces are at least one of embedded, integrally formed, surface deposited, and printed to the sheet.

15. A debris removal device for electrostatically removing debris comprising:

a sheet comprising a plurality of conductive traces;

a driver circuit positioned in electrical communication with the conductive traces of the sheet;

wherein each conductive trace is spaced apart from adjacent conductive traces;

wherein the driver circuit is configured to selectively energize subsets of the plurality of conductive traces;

wherein the plurality of conductive traces are positioned so as to define spacing therebetween within the range from about 5 mils to about 50 mils.

16. The debris removal device of claim 15 wherein the sheet comprises, first, second, third, and fourth electrical contacts positioned in electrical communication with the driver circuit; wherein the plurality of conductive traces comprises first, second, third, and fourth sets of conductive traces; wherein the first set of conductive traces are positioned in electrical communication with the first electrical contact; wherein the second set of conductive traces are positioned in electrical communication with the second electrical contact; wherein the third set of conductive traces are positioned in electrical communication with the third electrical contact; wherein the fourth set of conductive traces are positioned in electrical communication with the fourth electrical contact; and wherein the driver circuit is configured to energize each of the first, second, third, and fourth electrical contacts independently of each other, thereby energizing each of the first, second, third, and fourth sets of conductive traces independently of each other.

17. The debris removal device of claim 15 wherein the driver circuit is configured to iteratively perform a sequence of energizing each of the first, second, third, and fourth sets of conductive traces to move particulate matter off an exposed surface of the sheet.

18. The debris removal device of claim 15 wherein the driver circuit is configured to energize the plurality of conductive traces in a sequence of the first set of conductive traces, the second set of conductive traces, the third set of conductive traces, and the fourth set of conductive traces.

19. A debris removal system for electrostatically removing debris comprising:

a plurality of sheets, each sheet comprising a plurality of conductive traces;

a driver circuit positioned in electrical communication with the conductive traces of each sheet of the plurality of sheets;

wherein each sheet of the plurality of sheets is positioned adjacent to at least one other sheet;

wherein each conductive trace is spaced apart from adjacent conductive traces;

wherein the plurality of conductive traces are positioned so as to define spacing therebetween within the range from about 5 mils to about 50 mils;

wherein the plurality of conductive traces are configured to permit a voltage within the range from about 500 volts to about 3000 volts;

wherein the plurality of conductive traces are configured to generate electrostatic fields having a frequency within from about 100 Hz to about 2000 kHz;

wherein the driver circuit is configured to selectively energize subsets of sheets of the plurality of sheets sequentially; and wherein the driver circuit is configured to energize subsets of the plurality of conductive traces within each sheet of the plurality of sheets sequentially.

20. The debris removal system of claim 19 wherein each sheet of the plurality of sheets further comprises a slave driver circuit positioned in operational communication with the driver circuit and in electrical communication with the plurality of conductive traces in the sheet associated with the slave driver circuit; wherein the driver circuit is configured to send signals to the slave driver circuits and wherein the slave driver circuit is configured to selectively energize the plurality of conductive traces responsive to the signal received from the driver circuit.

* * * * *